US012410600B2

(12) United States Patent
Halloran et al.

(10) Patent No.: US 12,410,600 B2
(45) Date of Patent: Sep. 9, 2025

(54) TOILET WITH CANNED SUMP

(71) Applicant: Kohler Co., Kohler, WI (US)

(72) Inventors: Daniel N. Halloran, Fredonia, WI (US); Tony L. Lambert, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 69 days.

(21) Appl. No.: 17/866,163

(22) Filed: Jul. 15, 2022

(65) Prior Publication Data

US 2023/0036047 A1 Feb. 2, 2023

Related U.S. Application Data

(60) Provisional application No. 63/226,920, filed on Jul. 29, 2021.

(51) Int. Cl.
*E03D 11/10* (2006.01)
*E03D 11/18* (2006.01)

(52) U.S. Cl.
CPC ..... *E03D 11/10* (2013.01); *E03D 11/18* (2013.01); *E03D 2201/30* (2013.01); *E03D 2201/40* (2013.01)

(58) Field of Classification Search
CPC ..... E03D 11/02; E03D 11/13; E03D 11/18; E03D 2201/30; B28B 1/26–28; B28B 11/12
See application file for complete search history.

(56) References Cited

U.S. PATENT DOCUMENTS

| | | | | |
|---|---|---|---|---|
| 2,411,301 | A | 11/1946 | Jacques | |
| 4,316,864 | A | 2/1982 | Bramwell | |
| 8,032,956 | B2 * | 10/2011 | Prokopenko | E03D 11/08 4/425 |
| 2003/0115664 | A1 | 6/2003 | Kosugi et al. | |
| 2019/0106872 | A1 | 4/2019 | Grover et al. | |

(Continued)

FOREIGN PATENT DOCUMENTS

| | | | |
|---|---|---|---|
| CN | 105365030 | A | 3/2016 |
| EP | 0572280 | A1 | 12/1993 |
| FR | 2221252 | A1 | 10/1974 |

(Continued)

OTHER PUBLICATIONS

Extended European Search Report from European Patent Application No. 22 186 645.2, dated Jun. 24, 2025, 7 pages.

*Primary Examiner* — Erin Deery
(74) *Attorney, Agent, or Firm* — Lempia Summerfield Katz LLC

(57) ABSTRACT

A sump for a toilet includes a first end of the sump, defined by a first boundary, and a second end of the sump, defined by a second boundary. The sump includes a channel running from the first end of the sump to the second end of the sump defined by a sump surface. The first end of the sump is configured to receive liquid and the second end of the sump is configured to supply liquid. The sump has a sump can-cut diameter corresponding to a diameter of the channel at the first end of the sump, a sump side radius extending from a center of the channel to an inner surface of the channel, and a sump depth corresponding to a largest vertical distance within the channel. The sump may be drain cast using a single continuous pathway.

15 Claims, 12 Drawing Sheets

(56) References Cited

U.S. PATENT DOCUMENTS

| | | | |
|---|---|---|---|
| 2020/0102729 | A1 | 4/2020 | Lambert et al. |
| 2020/0332509 | A1 | 10/2020 | Smith et al. |

FOREIGN PATENT DOCUMENTS

| | | | | | |
|---|---|---|---|---|---|
| GB | 489438 | A | | 7/1938 | |
| JP | H068475 | U | | 2/1994 | |
| JP | 2001303648 | A | | 10/2001 | |
| JP | 2002348940 | A | | 12/2002 | |
| JP | 2004011414 | A | | 1/2004 | |
| JP | 5174504 | B2 | | 4/2013 | |
| JP | 2015194004 | A | | 11/2015 | |
| KR | 102017460 | B1 | | 8/2019 | |
| KR | 102074681 | B1 | | 2/2020 | |
| WO | WO-2012140607 | A2 | * | 10/2012 | ..... B28B 1/002 |
| WO | 2017056639 | A1 | | 4/2017 | |

* cited by examiner

TOILET WITH CANNED SUMP

CROSS-REFERENCE TO RELATED APPLICATION

This application claims priority benefit of Provisional Application No. 63/226,920 filed on Jul. 29, 2021, which is hereby incorporated by reference in its entirety.

FIELD

The present application relates generally to plumbing fixtures. More specifically, the present disclosure relates to plumbing fixtures that have a drain-casted sump.

BACKGROUND

Generally speaking, plumbing fixtures, such as toilets and urinals include a sump in which liquid and/or waste are collected. The sump being fluidly connected to a bowl of the toilet or urinal through which liquid and/or other waste may enter the sump. The sump is also fluidly connected to a trapway leading to a drain or sewer. Liquid and/or other waste flow from the sump through the trapway to a drain or sewer during a flushing operation. Generally, a jet orifice is provided in the sump. The jet orifice fluidly connects a drain channel, which supplies water to the jet orifice, to the sump. Water supplied from the drain channel, through the jet orifice, and to the sump facilitates the removal of liquid and/or other waste from the plumbing fixture during a flushing process.

Plumbing fixtures including a sump are typically manufactured using a solid cast process. In the solid cast manufacturing process, the bowl is solid cast using a mold and then holes fluidly connecting the sump to the drain channel and bowl are manually punched. Manually punching the holes that connect the sump to the drain channel and bowl require that there is sufficient room in the sump for the punching device to be inserted and properly positioned to punch the holes, thereby limiting the location and orientation of the jet orifice and the shape of the sump. Plumbing fixtures manufactured using a solid cast process have substantially rectangular shaped sump with few, if any, smooth continuous curved surfaces. Additionally, manually punching holes connecting the sump to the bowl and jet orifice may lead to material yield and inconsistent shape and location of the punched holes, reducing the flushing efficiency of the plumbing fixture.

BRIEF DESCRIPTION OF THE DRAWINGS

Exemplary embodiments are described herein with reference to the following drawings.

DETAILED DESCRIPTION

Figure 1:
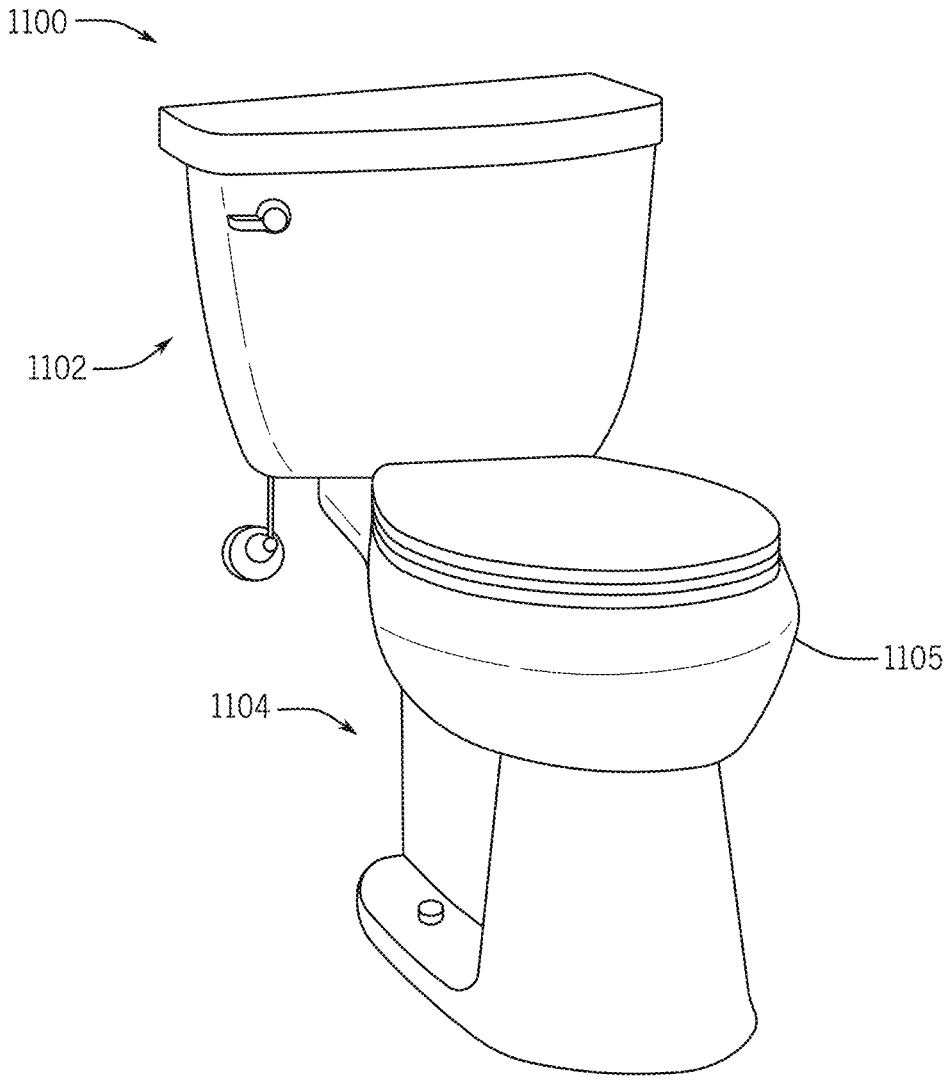
FIG. 1 illustrates a toilet with a canned sump according to an exemplary embodiment of the present disclosure.

Before turning to the figures, which illustrate certain exemplary embodiments in detail, it should be understood that the present disclosure is not limited to the details and methodology set forth in the description or illustrated in the figures. It should also be understood that the terminology used herein is for the purpose of description only and should not be regarded as limiting.

Generally speaking, sump waste removal fixtures, such as a toilet or urinal, include a sump in which liquid and waste in the toilet or urinal collect. The sump waste removal fixture generally includes an orifice, which may be a jet orifice, for introducing water into the trapway of the fixture. The water may be used to assist in the draining of the contents of the bowl and sump of the plumbing fixture. The contents of the bowl and sump may be drained through the trapway to a drain pipe or sewer line. Some plumbing fixtures are made from a vitreous material by a solid casting process, where a slip material or tube is utilized to form a hollow trapway within the plumbing fixture when the plumbing fixture is cast. After the plumbing fixture is cast, a sump mouth and a jet orifice are typically formed through a solid casted wall of the plumbing fixture by manually using a punch to fluidly couple the sump to the trapway and drain pipe and fluidly couple the jet orifice to the sump. A fluid channel typically directs fluid from a fluid supply source to the jet orifice to assist with draining. However, a significant amount of clearance is required to form the sump mouth and jet orifice using a manual punch. Accordingly, the shape of the sump and location and orientation of the sump mouth and jet orifice are limited. In addition, forming the sump mouth and jet orifice with a punch can result in significant material yield, and can result in inconsistent sizes or shapes of the jet orifice, thereby negatively impacting drain performance.

Referring generally to FIGS. 1 and 3-8, disclosed herein are plumbing fixtures (e.g., toilets, urinals, etc.) having a sump formed using a drain casting process instead of a manual punching operation. The drain casting process, advantageously, allows for the sump to be cast in many shapes not feasible using the solid cast method. The drain casting process allows the sump to be cast having smoother and more continuous walls, improving washing and waste removal. Additionally, the drain casting process, advantageously, allows the jet orifice to be located in the sump near the inlet of the trapway, improving fluid flow and draining of the trapway. Forming the sump mouth and the jet orifice using a drain-casting process instead of a punch provides a more consistent shape of the mouth and drain orifice with limited or no material yield during the manufacturing process. Additionally, the drain casting process may be used to improve manufacturability of plumbing fixtures having a sump.

The following description focuses primarily on a drain-casted sump for a toilet. However, it should be appreciated that the disclosed sump structure and drain casting process can be applied to a variety of other types of plumbing fixtures and trapways, such as a urinal, lavatories, or other plumbing fixtures that include a sump, trapway, and a drain.

Referring to FIG. 1, a toilet 1100 with a canned sump is illustrated according to an exemplary embodiment of the present disclosure. The toilet 1100 may include a tank (e.g., container, reservoir, etc.), shown as a tank 1102, and a pedestal (e.g., base, stand, support, etc.), shown as a pedestal 1104. The tank 1102 may be coupled to, and supported by, the pedestal 1104, which may be positioned on a floor. In some embodiments, the tank 1102 and the pedestal 1104 may be formed together as a single component. The tank 1102 is configured to receive water (e.g., via a fill valve of the toilet 1100, etc.) and store the water in between flushes. The pedestal 1104 includes a bowl 1105 and may be configured to receive the water from the tank 1102 to flush contents of bowl into a sewage line. In some embodiments, the pedestal 1104 may be mounted on the wall of a lavatory and the bowl 1105 may be configured to receive water from a fluid supply source such as a household water supply.

The bowl 1105 of the pedestal 1104 includes a sump (e.g., a receptacle) and an outlet opening, wherein water and waste is collected in the sump until being removed through the outlet opening, such as when the contents of the bowl 1105 are flushed into a sewage line. The toilet 1100 further includes a trapway, the trapway being fluidly connected to the bowl 1105 via the sump. The trapway fluidly connects the sump to the outlet opening.

Figure 2:
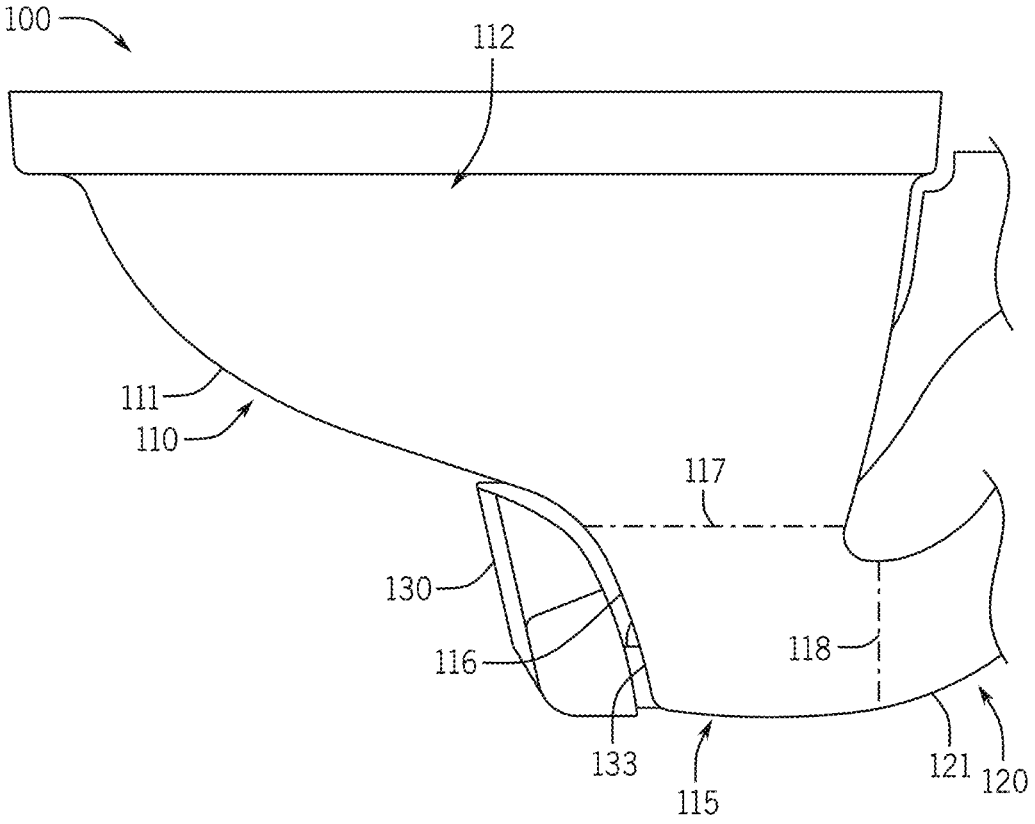
FIG. 2 illustrates a right-side perspective view of a solid cast toilet.

Referring to FIG. 2, a toilet 100 including a sump 115 formed using a solid casting method is shown. The toilet 100 includes a bowl 110 having an inlet 112 defined by a bowl surface 111. The toilet 100 further includes a sump 115 defined by a sump surface 116 extending from an upper boundary 117 (i.e., a sump mouth) located at the bowl surface 111 to a lower boundary 118 located at a trapway 120. The trapway 120 is defined by a trapway surface 121. The sump 115 fluidly connects the bowl 110 and the trapway 120. The sump surface 116 extends from the bowl surface 111 to the trapway surface 121 and is coextensive with the bowl surface 111 and trapway surface 121. The toilet 100 further includes a drain channel 130 extending partially in front of the sump 115. In some embodiments the toilet 100 may have two drain channels connecting partially in front of the sump 115. In some embodiments, the drain channel 130 may extend partially below the sump 115. The drain channel 130 may be fluidly coupled to a fluid supply source, such as a household water supply. The drain channel 130 includes a drain opening that is defined by a drain surface. The drain channel 130 terminates at the sump surface 116 to define a jet orifice 133 (e.g., sump jet orifice, etc.). The jet orifice 133 may be located on a front or a bottom surface of the sump 115. The toilet 100 is configured such that the drain channel 130 can direct a flow of water from the water supply source to the jet orifice 133, where the flow of water can be introduced to the sump 115 to, for example, to help prime a siphon in the trapway 120 to induce a flush cycle and empty the contents of the bowl 110.

In the toilet 100, according to the casting method of FIG. 2, a significant amount of clearance is required to manually punch the holes for the sump mouth, located at the upper boundary 117 of the sump 115 and the jet orifice 133. Accordingly, the geometry of the sump 115 is limited to that which will allow the punch to fit inside the sump 115 to manually punch the sump mouth and jet orifice 133. Similarly, the location and orientation of the sump mouth and jet orifice 133 are limited to those locations and orientations that can be manually punched. Additionally, manual punching can lead to significant material yield and inconsistent size and locations of the jet orifice, negatively impacting drain performance.

Figure 3:
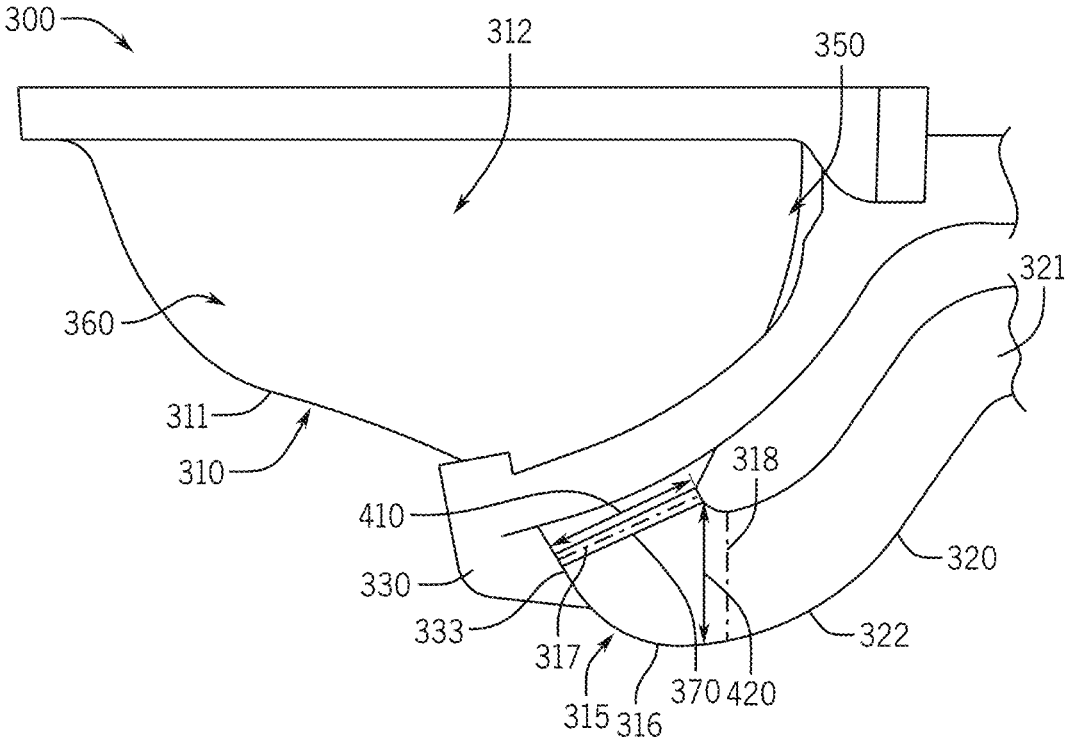
FIG. 3 illustrates a right-side perspective view of a toilet according to an exemplary embodiment of the present disclosure.
Figure 4:
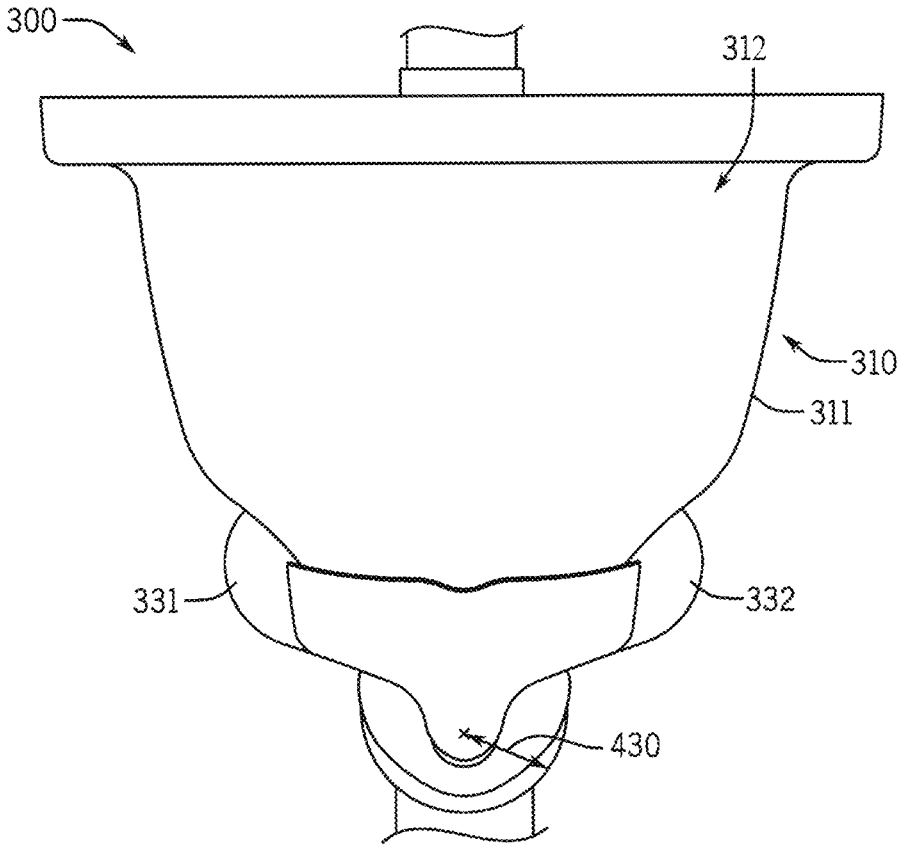
FIG. 4 illustrates a front perspective view of the toilet of FIG. 3 according to an exemplary embodiment of the present disclosure.
Figure 5:
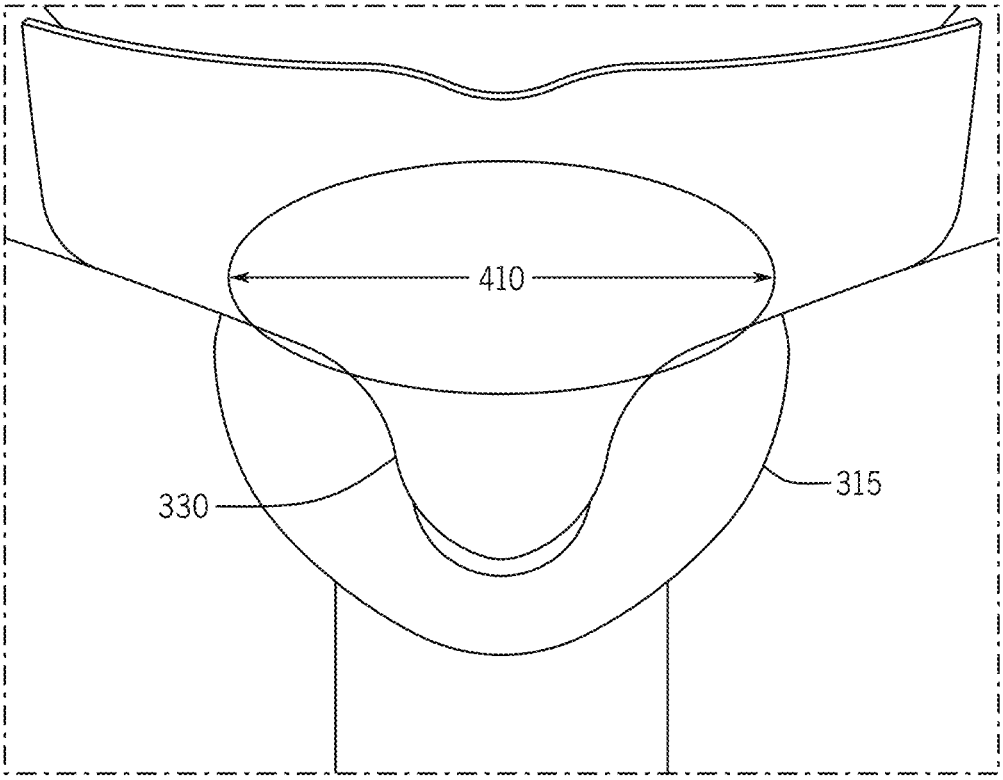
FIG. 5 illustrates a zoomed-in perspective view of the toilet of FIGS. 3 and 4 according to an exemplary embodiment of the present disclosure.

Referring to FIGS. 3-5 a toilet 300 according to an exemplary embodiment of the present disclosure is shown. The toilet 300 includes a bowl 310 having an inlet 312 defined by a bowl surface 311. The toilet further includes a sump 315 defined by a sump surface 316 that extends from an interior surface of the bowl 310 at an upper boundary 317 (e.g., sump mouth) to an interior surface of the trapway 320 at a lower boundary 318. The sump surface 316 may be an inside surface of the channel within the sump 315. The sump fluidly connects the bowl 310 and the trapway 320. The sump surface 316 extends from, and is coextensive with, the bowl surface 311. The sump 315 may have a sump depth 420 corresponding to a largest vertical distance within the channel of the sump 315 fluidly connecting the bowl 310 and the trapway 320. The sump 315 may have a sump can cut diameter 410 corresponding to a diameter of the channel formed within the sump 315 at a first end of the sump (e.g., a sump mouth) formed by a boundary between the bowl 310 and the sump 315. The boundary between the bowl 310 and the sump 316 may be a location at which a can is used to remove a clay cap, fluidly connecting the bowl 310 and the sump 315. The sump can cut diameter 410 is the diameter (e.g., distance) of the sump surface 316 at the point which the bowl 310 and the sump 315 meet. Referring to FIG. 4, the sump 315 may have a sump side radius 430 extending from a center of the channel within the sump 315 to an inside surface of the channel (e.g., sump surface 316).

The sump surface 316 is coextensive with a trapway surface 322 that defines a trapway opening. The trapway opening extends to an outlet port 321 for connecting the toilet 300 to a sewer or drain. In this exemplary embodiment, the toilet 300 including trapway 320 is configured as a siphonic toilet, whereby the contents of the bowl 310 are emptied by creating a siphon effect in the trapway 320, the details of which are discussed below. According to another exemplary embodiment, the toilet 300 may be configured as a blowout style jetted toilet.

The toilet 300 further includes a drain channel 330 extending partially in front of the sump 315. In some embodiments the toilet 300 may include a left drain channel 331 and a right drain channel 332. In other embodiments, the toilet 300 may only include one drain channel 330. In some embodiments, the drain channel 330 may extend partially below the sump 315. The drain channel 330 may be fluidly coupled to a fluid supply source, such as a household water supply. The drain channel 330 includes a drain opening that is defined by a drain surface. The drain channel terminates at the sump surface 316 to define a jet orifice 333 (e.g., sump jet orifice, etc.). The jet orifice 333 may be located on a front or bottom surface of the sump 315. The toilet 300 is configured such that the drain channel 330 can direct a flow of water from a fluid supply source to the jet orifice 333, where the flow of the water can be introduced to the sump 315 to, for example, help to prime a siphon in the trapway 320 to induce a flush cycle and empty the contents of the bowl 310. In some embodiments, the toilet 300 may include two or more jet orifices. The two or more jet orifices may both be included in a continuous drain cast channel used to form the toilet 300.

Figure 8:
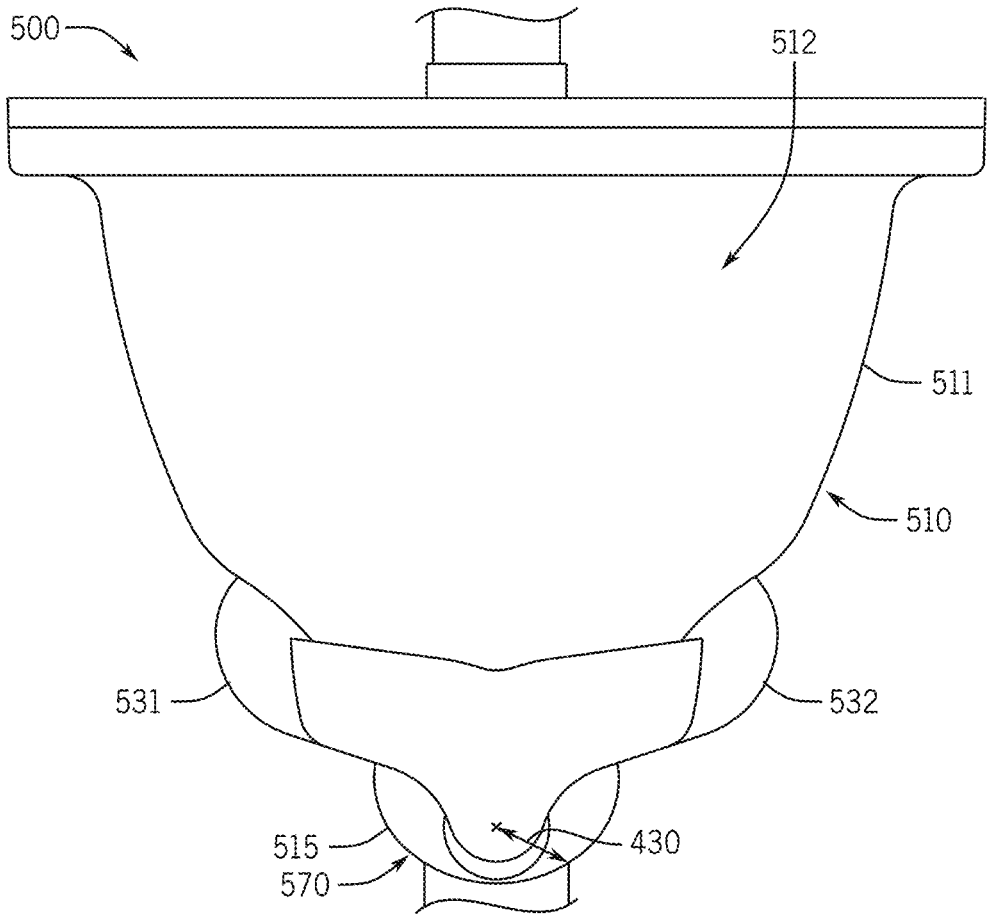
FIG. 8 illustrates a front view of the toilet of FIG. 7 including a drain cast sump with dimples.

The toilet 300 according to FIGS. 3-5 may be cast using a drain casting method, such as the method as shown in FIG. 8. Drain casting the toilet 300 advantageously allows the sump 315 to be cast in a wide variety of shapes as a punch does not need to be inserted into the sump to manually punch holes connecting the sump to the jet orifice and/or the toilet bowl. Additionally, drain casting the sump allows the bowl, drain channel, and sump all to be fluidly connected by a single operation of opening the sump mouth using a can. The toilet 300 may be advantageously cast to have a specific ratio of can-cut diameter 410 over sump depth 420 and/or cast to have a specific ratio of can-cut diameter 410 over sump side radius 430. The flushing efficiency of the toilet 300 may be improved by having a sump 315 having a specific ratio of can-cut diameter 410 over sump depth 420 and/or a specific ratio of can-cut diameter 410 over sump side radius 430. The flushing efficiency of the toilet 300 may be measured using series of tests and/or models, for example adding granules/particles to the contents of a toilet bowl and determining how many granules/particles remain in the bowl after a flushing cycle, measuring the flow rate of liquid through the sump and/or trapway during a flushing cycle, and the like.

In some examples, the ratio of the sump can-cut diameter over the sump radius may be 2.2 to 2.4. In other examples, the ratio of sump can-cut diameter over the sump side radius may be 2.4 to 2.6. In other examples, the ratio of sump can-cut diameter over the sump side radius may be greater than 2.6. In some examples, the ratio of sump can-cut diameter over the sump depth is 1 to 1.2. In other examples, the ratio of sump can-cut diameter over the sump depth is 1.2 to 1.4. In some examples, the ratio of sump can-cut diameter over the sump depth is greater than 1.4. In some examples, the ratio of sump can-cut diameter over sump depth is greater than 1.15 and the ration of the sump can-cut diameter over sump side radius is greater than 2.3.

Figure 6:
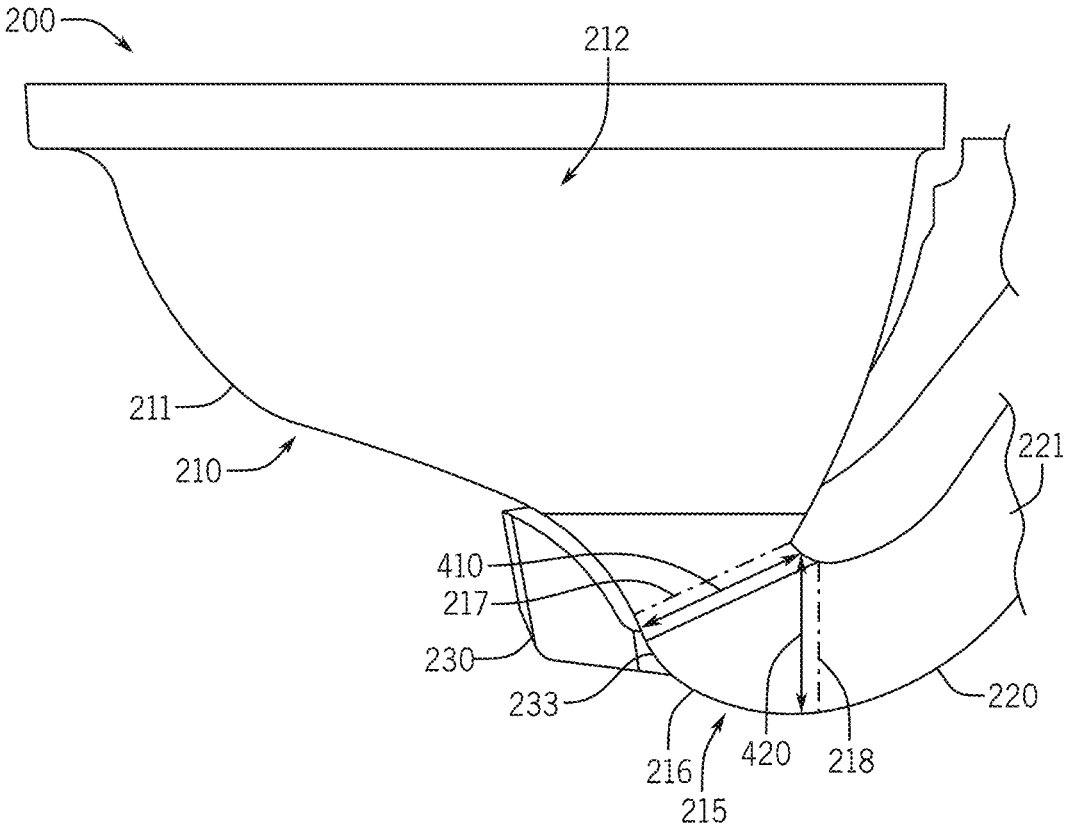
FIG. 6 illustrates a right-side perspective view of a toilet according to an exemplary embodiment of the present disclosure.

Referring to FIG. 6, a toilet 200 including a drain cast sump according to an exemplary embodiment of the present disclosure is shown. The toilet 200 includes a bowl 210 having an inlet 212 defined by a bowl surface 211. The toilet further includes a sump 215 defined by a sump surface 216 that extends from the bowl 210 at an upper boundary 217 to a trapway 220 and a lower boundary 218. The sump 215 fluidly connects the bowl 210 and the trapway 220. The sump surface 216 extends from, and is coextensive with, the bowl surface 211. The sump 215 has a sump depth 420 and a sump can-cut diameter 410. The sump can-cut diameter 410 is the diameter of the sump surface 316 at the point at which the sump 215 and the bowl 210 meet. The sump 215 further has a sump side radius extending from a center of the sump 215 to an inside surface of the sump (not shown).

The sump surface 216 is coextensive with the trapway surface 322 that defines a trapway opening. The trapway extends from the sump 215 to an outlet 221 for connecting the toilet 200 to a sewer or drain. In this embodiment, the toilet 200 has one drain channel 230, extending partially in front of the sump 215. In this embodiment, the drain channel 230 fluidly connects a fluid supply source to a jet orifice 233 located at the sump surface 216. The drain channel 230 is configured to direct a flow of liquid from the water supply source to the sump 215.

Figure 7:
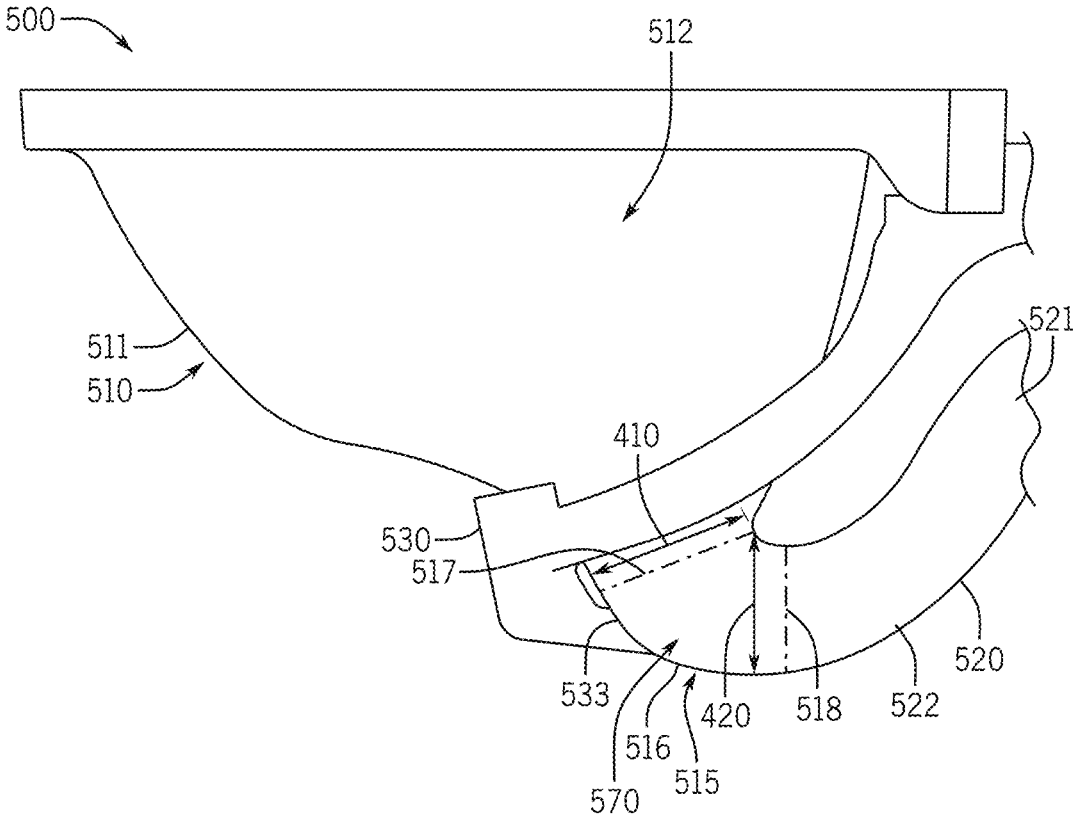
FIG. 7 illustrates a side view of a toilet including a drain cast sump with dimples according to an embodiment of the present disclosure.

Referring to FIGS. 7 and 8, a toilet 500 including a drain cast sump with dimples is shown according to another exemplary embodiment of the present disclosure. The toilet 500 includes a bowl 510 having an inlet 512 defined by a bowl surface 511. The toilet 500 further includes a sump 515 defined by a sump wall 516 that extends from the bowl 510 at an upper boundary 517 to a trapway 520 at a lower boundary 518. The sump 515 fluidly connects the bowl 510 and the trapway 520. The sump surface 516 extends from, and is coextensive with, the bowl surface 511. The sump 515 has a sump depth 420 and a sump can-cut diameter 410. The sump can-cut diameter 410 is the diameter of the sump surface 516 at the point at which the sump 515 and the bowl 510 meet. Referring to FIG. 7B, the sump 515 has a sump side radius 430 extending as a perpendicular distance (perpendicular from the direction of flow) from the center of the sump 515 to the inside surface or outside surface of the sump 515. The sump side radius 430 may be measured from one or more dimples 570 as described below.

The sump surface 516 is coextensive with the trapway surface 522 that defines a trapway opening. The sump 515 and the trapway 520 may have a substantially circular cross section. The trapway 520 extends from the sump 515 to an outlet 521 for connecting the toilet 500 to a sewer or a drain. The toilet 500 includes a drain channel 530. In some embodiments, the toilet 500 may include two drain channels. In some embodiments, the drain channel 530 may extend partially in front of the sump 515. In some embodiments, the drain channel 530 may extend partially below the sump 515. The drain channel 530 may be fluidly coupled to a fluid supply source and includes a drain opening that is defined by a drain surface. In some embodiments, the toilet 500 may have a left drain channel 531 and a right drain channel 532. The drain channel 530 may connect the fluid supply source to a jet orifice 533 located at the sump surface 516. The jet orifice 533 may be located on a front of the sump surface 516. The jet orifice 533 may be located on the bottom of the sump surface 516. The drain channel 530 is configured to direct a flow of water from the fluid supply source to the sump 515 to, for example, induce a flush cycle.

The toilet 500, further includes one or more dimples 570 located on the sump 515 and/or trapway 520. The dimples 570 may be substantially flat portions of the sump 515 and/or trapway 520 in which the sump surface 516 and/or the trapway surface 522 are located closer to the center of a sump 515 and/or trapway 520 having an otherwise circular cross section. The dimples 570 may be located completely on the sump 515, completely on the trapway 520, and/or on both the sump 515 and the trapway 520. Referring to the perspective view of FIG. 8, in some embodiments, the sump 515 and/or trapway 520 may have two dimples 570*a*, 570*b*, one located on each of the left and right side of the sump. The dimples 570*a*, 570*b* may improve the flushing efficiency of the toilet 500. The dimples 570*a*, 570*b* may cause more liquid entering the sump 515 through the drain channel 530 to contact the sump surface 516 and/or the trapway surface 522 improving surface washing and waste removal during a flushing cycle.

Figure 9:
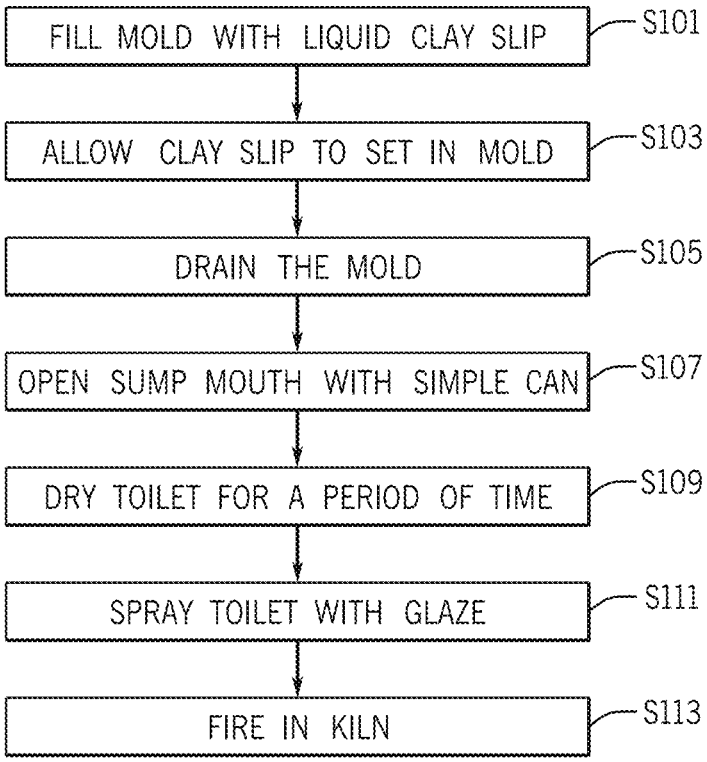
FIG. 9 illustrates a drain cast method of forming the sump according to an exemplary embodiment of the present disclosure.

Referring to FIG. 9, a flow chart for a drain-cast method of forming a sump according to an exemplary embodiment of the present disclosure is provided. The method of FIG. 9 may be used to form any of the sumps 315, 215, 515 described herein. The method of FIG. 9 is described below with reference to the sump 315 of FIGS. 3-5. Additional, different, or fewer acts may be provided.

At act S101, a mold having the basic shape and structure of the toilet 300 is filled with liquid clay slip. The mold is oriented such that the front portion 360 is located on the bottom of the mold with the rear portion 350 oriented in an upward direction above the front portion 360. During the initial forming step S101, the toilet 300 includes a circular clay cap 370 disposed in the trapway 320 at the boundary between the co-extensive walls of the bowl surface 311 and the sump 315. The circular clay cap 370 blocks the flow of liquid slip between the toilet bowl surface 311 and the sump 315. During the initial forming step S101, the drain channel 330, including the mouth 333 of the drain channel are open and fluidly connected to the sump 315 and the trapway 320 so as to define a drain cast pathway of the toilet 300. The liquid clay slip extends through the drain channel 330, the jet orifice 333 of the drain channel, the sump 315, the trapway 320, to an outlet port 321. In other words, the toilet 300 is designed such that the drain channel 330, jet orifice 333 of the drain channel, the sump 315, and the trapway 320 cooperatively define a continuous drain cast pathway of the toilet 300.

At act S103, the liquid slip may set up in the cast to form the various solid cast walls of the toilet 300. The mold may draw moisture from the liquid clay slip. As moisture is drawn from the liquid clay slip, a thickness forming the solid cast walls of the toilet 300 may accumulate within the mold. The liquid clay slip may set for a predetermined period of time corresponding to a desired thickness of the various solid cast walls of the toilet 300.

At act S105, the mold pins are removed such that the liquid slip remaining in the mold drains from the drain channel 330, jet orifice 333 of the drain channel, sump 315 and trapway 320 of the mold. During the third step act S105 additional forming parts (e.g., funnels for directing liquid slip into the molds, etc.) may be removed from the mold. Further, in some embodiments, during act S105, the mold may be rotated (e.g., an orientation of the mold may be changed). In some examples, the mold may be rotated to assist in draining the liquid clay slip from the drain channel 33, jet orifice 333 of the drain channel, sump 315, and the trapway 320. In other embodiments, the mold may be rotated in preparation for act S107.

Figure 10:
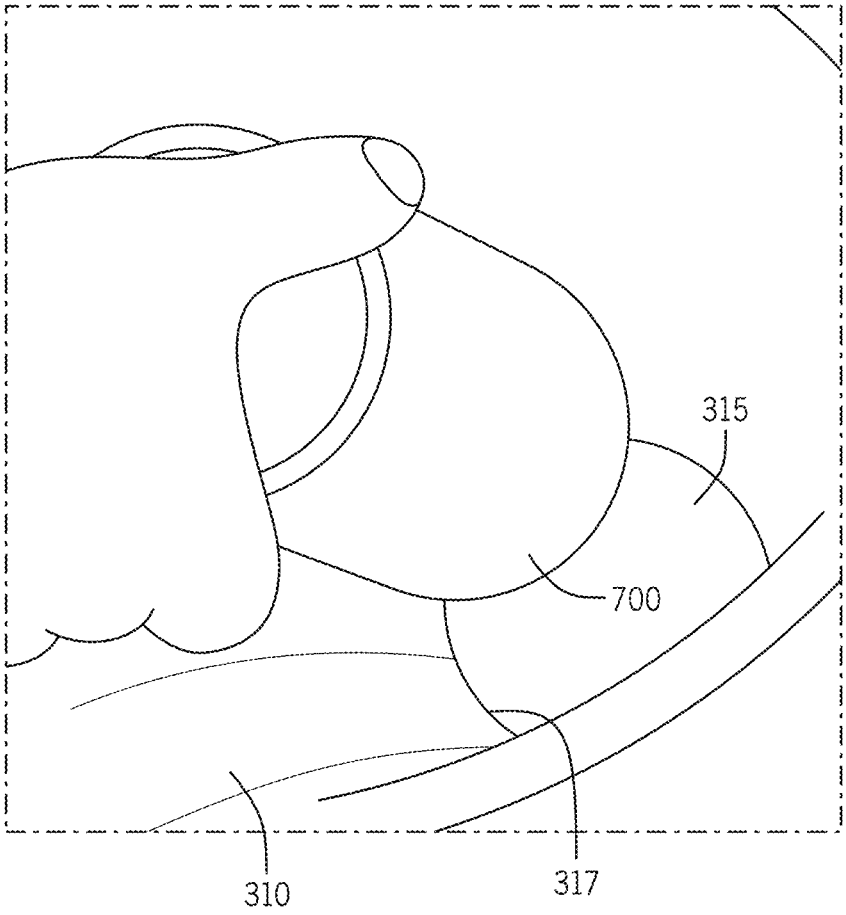
FIG. 10 illustrates a can and a toilet according to an exemplary embodiment of the present disclosure.

At act S107, a can may be used to cut out the circular clay cap 370 disposed between the bowl 310 and the sump 315. FIG. 10 described below illustrates toilet and a can according to an exemplary embodiment of the present disclosure. The can may be inserted into the bowl 310 of the toilet and positioned such that an opening of the can is aligned with the clay cap 370. The can may be pushed into the clay cap 370, cutting the clay cap 370 from between the bowl 310 and the sump 315. The can may then be withdrawn from between the bow 310 and the sump 315. The clay cap 370 may be removed as the can is withdrawn from between the bowl 310 and the sump 315.

At act S107, removing the clay cap 370 opens the sump mouth fluidly connecting the bowl 310 and the sump 315. In some embodiments, the can may be rotated or twisted as it is inserted into the clay cap 370 between the bowl 310 and the sump 315. In some embodiments, the can may be rotated or twisted as it is withdrawn from between the bowl 310 and the sump 315. The can may be rotated during insertion and/or withdrawal to improve the quality of the cut as the clay cap 370 is removed. Improving the quality of the cut may improve the surface quality of the connection (e.g., sump mouth, can cut diameter) between the bowl 310 and the sump 315. Thus, the quality of a fluid flowing through the connection (e.g., sump mouth, can cut diameter) may be improved.

In some embodiments, a caster may manually cut out the clay cap 370 between the bowl 310 and the sump 315. In some examples, a tool having the shape of the bowl 310 may be used to position the can at the correct location in the bowl to cut out the circular clay cap 370. In other embodiments, an automated machine or device may use the can to cut out the circular clay cap. During act S107, additional forming parts remaining in the mold (e.g., a center part, a core, a front part, etc.) may be removed.

At act S109, the toilet 300 is dried for a period of time. The toilet 300 may be dried for a predetermined period of time allowing moisture to be wicked from the toilet 300. At act S111, the toilet may be sprayed with a glaze. At act S113, the toilet may be fired in a kiln to form the final toilet 300. Additional, fewer, and/or different steps may be included.

FIG. 10 illustrates a toilet 300 and a can 700 used to open the sump mouth according to an exemplary embodiment of the present disclosure. FIG. 10 illustrates the can 700 and toilet 300 after the can 700 has been used to remove the circular clay cap disposed between the bowl 310 and the sump 315 of the toilet 300. FIG. 10 may illustrate the can 700 being withdrawn from the bowl 310 at act S107 of the method of FIG. 9 described above. In some embodiments, as illustrated in FIG. 10, a caster may manually open the sump mouth using the can 700. In some embodiments, a tool having a shape matching a portion of the bowl may be used to position the can 700 in the correct position before opening the sump mouth may be used.

Figure 11:
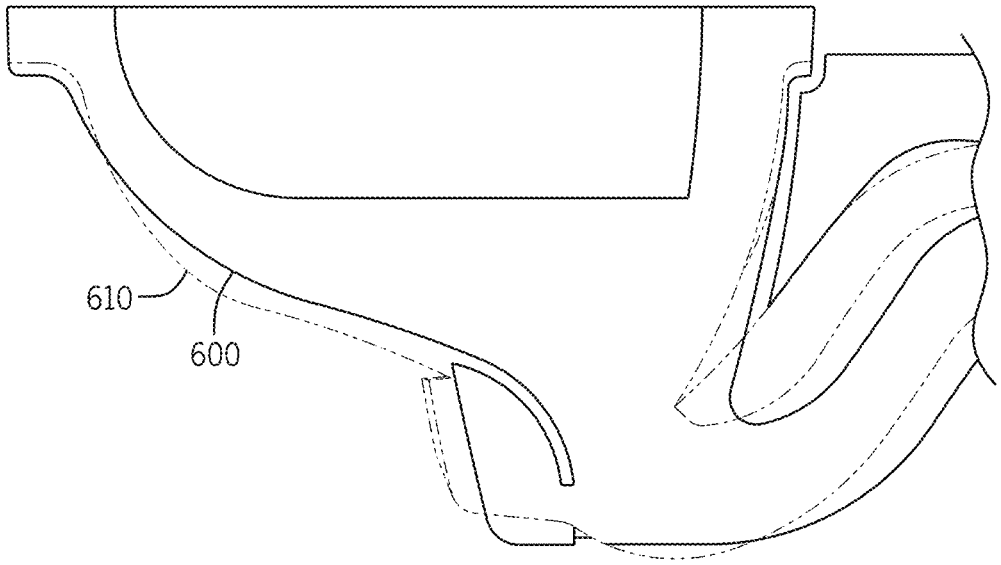
FIG. 11 is a side view of a traditional solid cast toilet overlayed on top of a toilet including a drain cast sump according to an exemplary embodiment of the present disclosure.
Figure 12:
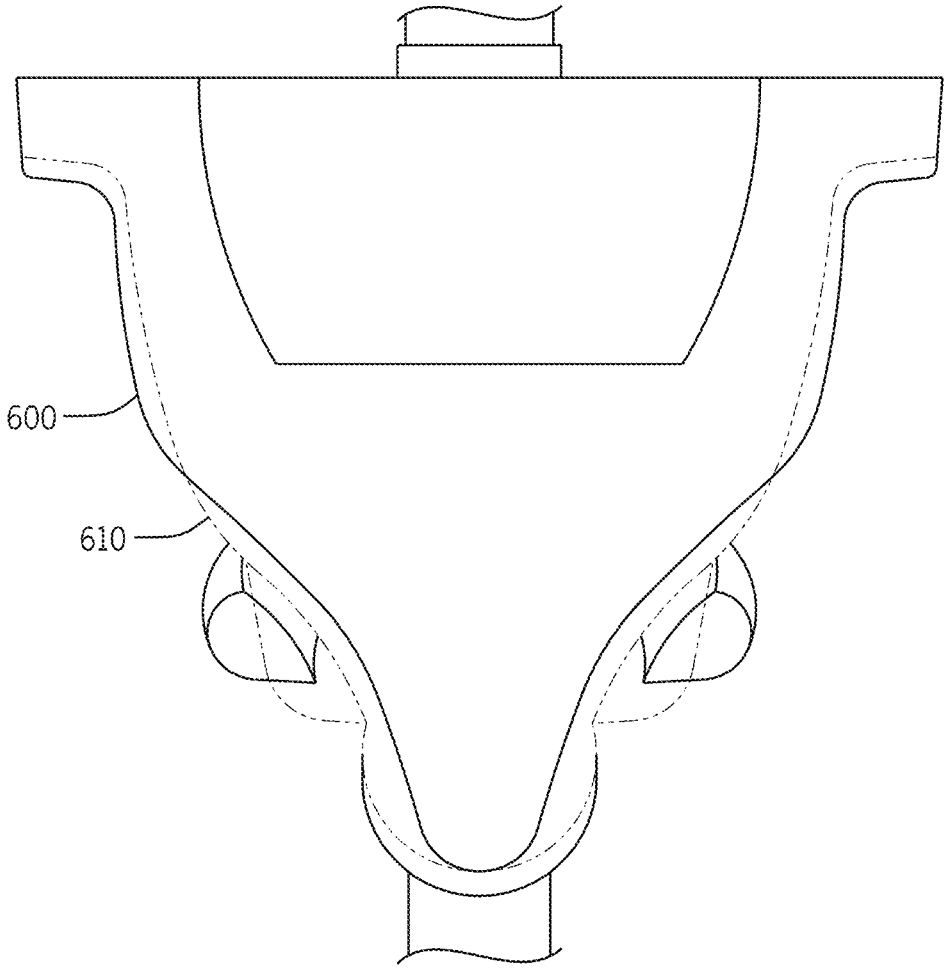
FIG. 12 is a front view of the traditional solid cast toilet overlayed on top of a toilet including a drain cast sump of FIG. 11.

Referring to FIGS. 11 and 12, a side view and a front view, respectively, of a solid cast toilet 600 overlayed on a drain cast toilet 610, according to an exemplary embodiment of the present disclosure, is shown. FIG. 11 illustrates a right-side perspective view of a solid cast toilet 600 overlayed on a drain cast toilet 610 according to an exemplary embodiment of the present disclosure. FIGS. 11 and 12 illustrate differences in geometry of the solid cast toilet 600 and the drain cast toilet 610. During manufacture of the drain cast toilet 610, opening the sump mouth (e.g., cutting out/removing the circular clay cap) using a can, as opposed to a punch, and not having to open the jet orifice allows the bowl and sump to be manufactured having with a wider variety of shapes. In the drain cast toilet 610, the bowl and sump may be manufactured with a wider variety of shapes because a punch does not need to be inserted into the sump and only one operation is performed (i.e., opening the sump mouth with the can) as opposed to two operations in the solid cast toilet (i.e., punching the connection between the sump and the drain channel and punching the connecting between the sump and the bowl). For example, the drain cast toilet 610 as disclosed herein may have more vertical surfaces, improving surface washing and waste removal.

Plumbing fixtures employing the apparatuses and methods as disclosed above may additionally be manufactured using a toilet rim, for example a tile-on rim, that is cast separately from other components of the plumbing fixture. The tile-on rim may be a solid annular member disposed around a top of the toilet bowl, surrounding an opening in the bowl. The tile-on rim may be planar including a flat top and/or bottom surface. The tile-on rim may be coupled to the bowl by way of a bonding material (e.g., adhesives, cements, and the like) and/or one or more fasteners. For example, the bonding material may be clay, ceramic, or vitreous (e.g., a "slip-roll" clay) that is applied to one or both of the tile-on rim and the bowl as a paste or malleable solid, such as a semi-liquid and a semi-solid material, then heated (e.g., in a kiln or oven) to permanently fuse the tile-on rim and the bowl together.

The tile-on rim may be disposed entirely above a water channel formed in the bowl (e.g., a water channel configured to supply water to the bowl). The tile-on rim may be formable by a molding or casting process. For example, the tile-on rim may be made of a porcelain or vitreous material. The tile-on rim may include a back portion extending from a rear of the annular portion. The back portion may be configured to receive fasteners for securing the tile-on rim to the toilet and/or fasteners for securing a tank to the rim. The annular portion of the rim may be configured to receive a seat for supporting a user of the toilet, the seat may be disposed above the rim.

The tile-on rim couples to and abuts an upper surface of the bowl. In some embodiments, the tile-on rim may be affixed to the bowl using bonding material and/or one or more fasteners. The bonding material may be applied around a portion of or the entire perimeter of the surface between the tile-on rim and the structure. In some examples, the tile-on rim may define a top of a water channel formed in the bowl (e.g., a water channel configured to supply water to the bowl). The use of tile-on rims with embodiments of the present disclosure may further improve manufacturability of the plumbing fixtures. For example, the toilets may be manufactured more quickly, or the number of steps that must be performed manually may be reduced.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the system as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

When a component, element, device, or the like of the present disclosure is described as having a purpose or performing an operation, function, or the like, the component, device, or element should be considered herein as being "configured to" meet that purpose or to perform that operation or function.

What is claimed is:

1. An assembly for a toilet, including a sump, the sump comprising:

a first end of the sump, defined by a first boundary;

a second end of the sump, defined by a second boundary;

a channel running from the first end of the sump to the second end of the sump defined by a sump surface;

a drain channel; and a jet orifice fluidly connected to the drain channel and the sump, the jet orifice configured to deliver liquid to the sump, wherein the first end of the sump is configured to receive liquid and the second end of the sump is configured to supply liquid, wherein the sump has a sump can-cut diameter corresponding to a diameter of the channel at the first end of the sump, a sump side radius extending from a center of the channel to an inside surface of the channel, and a sump depth corresponding to a largest vertical distance within the channel, and wherein the drain channel, jet orifice, and sump are drain cast using a single continuous drain cast pathway fluidly connecting the drain channel, the jet orifice, and the sump, such that a smooth and continuous curved surface is formed by the drain channel, the jet orifice, and the sump.

2. The assembly of claim 1, wherein the ratio of the sump can-cut diameter over the sump side radius is 2.2 to 2.4.

3. The assembly of claim 1, wherein the ratio of the sump can-cut diameter over the sump side radius is 2.4 to 2.6.

4. The assembly of claim 1, wherein the ratio of the sump can-cut diameter over the sump side radius is greater than 2.6.

5. The assembly of claim 1, wherein the ratio of the sump can-cut diameter over the sump depth is 1.0 to 1.2.

6. The assembly of claim 1, wherein the ratio of the sump can-cut diameter over the sump depth is 1.2 to 1.4.

7. The assembly of claim 1, wherein the ratio of the sump can-cut diameter over the sump depth is greater than 1.4.

8. The assembly of claim 1, wherein the ratio of the sump can-cut diameter over the sump depth is greater than 1.15 and the ratio of sump can-cut diameter over sump side radius is greater than 2.3.

9. The assembly of claim 1, further comprising:

at least one dimple located on the sump, wherein the at least on dimple reduces the sump side radius along a portion of the sump.

10. A toilet, comprising:

a bowl;

a sump including a channel fluidly connected to the bowl, the sump having a can-cut diameter corresponding to a diameter of the channel at a location where the channel is fluidly connected to the bowl, a sump side radius extending from a center of the channel to an inside surface of the channel, and a sump depth corresponding to a largest vertical distance within the channel;

a drain channel;

a jet orifice fluidly connected to the drain channel and the sump, the jet orifice configured to deliver the liquid to the sump; and a trapway, fluidly connected to the sump, wherein, the drain channel, jet orifice, sump, and trapway are drain cast using a single continuous drain cast pathway fluidly connecting the drain channel, the jet orifice, the sump, and the trapway, such that a smooth and continuous curved surface is formed by the drain channel, jet orifice, and sump.

11. The toilet of claim 10, wherein the ratio of the sump can-cut diameter over the sump side radius is 2.4 to 2.6.

12. The toilet of claim 10, wherein the ratio of the sump can-cut diameter over the sump side radius is greater than 2.6.

13. The toilet of claim 10, wherein the ratio of the sump can-cut diameter over the sump depth is 1.2 to 1.4.

14. The toilet of claim 10, wherein the ratio of the sump can-cut diameter over the sump depth is greater than 1.4.

15. The toilet of claim 10, wherein the ratio of the sump can-cut diameter over the sump depth is greater than 1.15 and the ratio of sump can-cut diameter over sump side radius is greater than 2.3.

* * * * *